US006237688B1

(12) United States Patent
Burleson et al.

(10) Patent No.: US 6,237,688 B1
(45) Date of Patent: May 29, 2001

(54) PRE-DRILLED CASING APPARATUS AND ASSOCIATED METHODS FOR COMPLETING A SUBTERRANEAN WELL

(75) Inventors: John D. Burleson, Denton; Flint R. George, Flower Mound, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/431,734

(22) Filed: Nov. 1, 1999

(51) Int. Cl.[7] ..... E21B 33/16; E21B 43/11

(52) U.S. Cl. ..... 166/281; 166/287; 166/288; 166/289; 166/300; 166/303; 166/308; 166/376; 166/74

(58) Field of Search ..... 166/281, 285, 166/287–289, 300, 302, 303, 308, 376, 74

(56) References Cited

U.S. PATENT DOCUMENTS 5,320,178 * 6/1994 Cornette .
5,355,956 10/1994 Restarick ..... 166/296
5,685,372 * 11/1997 Gano .

* cited by examiner

*Primary Examiner*—Roger Schoeppel
(74) *Attorney, Agent, or Firm*—William M. Imwalle; J. Richard Konneker

(57) ABSTRACT

A tubular casing section for a subterranean well has side wall apertures therein which are temporally sealed with plug structures. The plugged casing section is positioned within a wellbore at a selected subterranean formation and cemented in place within the wellbore. The plugs are removed, such as by melting, fracturing, shearing or corrosion, and a stimulation tool is lowered into the casing and operated to pierce through the cement lining at the unplugged casing side wall apertures and into the surrounding subterranean formation to establish communication between the formation and the interior of the casing.

23 Claims, 5 Drawing Sheets

PRE-DRILLED CASING APPARATUS AND ASSOCIATED METHODS FOR COMPLETING A SUBTERRANEAN WELL

BACKGROUND OF THE INVENTION

The present invention generally relates to apparatus and methods for completing subterranean wells and, in a preferred embodiment thereof, more particularly relates to the completion of a subterranean well using a pre-drilled casing section having plugged side wall apertures therein which may be opened downhole in conjunction with the process of communicating an adjacent subterranean formation with the interior of the casing section via its side wall apertures.

In a conventional completion process for a subterranean well, a well bore is extended through a subterranean formation, and a tubular casing structure is coaxially positioned within the wellbore to maintain the integrity of the wellbore, and facilitate subsequent placement of various downhole tools in the well. After placement of the casing within the well bore, the casing is laterally enveloped within a cement liner structure by forcing cement downwardly through the casing, outwardly through its lower end, and back up the well bore along the exterior surface of the casing. The resulting external cement liner on the casing serves to prevent undesirable vertical communication between various formations via the space between the exterior side surface of the casing and the side surface of the well bore.

Next, an explosive-based perforating gun structure is lowered into the cemented-in casing to a position vertically adjacent the formation to be perforated. Firing of the perforating gun detonates various shaped explosive charges thereon, with each of the detonated shaped charges sequentially penetrating an adjacent portion of the casing side wall, the adjacent cement lining, and a portion of the formation extending outwardly from the cement lining. This explosive penetration of the formation operatively communicates it with the interior of the now perforated casing so that production fluid from the formation may enter the casing for appropriate retrieval and transport to the surface in a well known manner.

This conventional use of a perforating gun carries with it the usual risks, inconveniences and unreliability associated with dealing with highly explosive materials. Moreover, when utilizing a perforating gun the operator must often contend with the deploying, dropping and recovering the perforation equipment.

As can readily be seen from the foregoing, a need exists for improved apparatus and associated methods for communicating the interior of a well casing with a surrounding subterranean formation. It is to this need that the present invention is directed.

SUMMARY OF THE INVENTION

In carrying out principles of the present invention, in accordance with a preferred embodiment thereof, a subterranean well is completed using a specially designed tubular casing section having side wall apertures which are sealingly covered by plug structures that are removable downhole to re-establish communication between the interior of the casing section and its outer side via the side wall apertures.

According to one illustrated method, the plug structures are of a eutectic material, and a casing assembly, having a longitudinal portion defined by the apertured casing section, is positioned within a wellbore with the plugged casing side wall apertures adjacent a portion of a preselected subterranean formation. A sealing layer is formed outwardly around the positioned casing assembly by sequentially flowing a sealing material, representatively a cement material, downwardly therethrough, outwardly therefrom, and then upwardly between the exterior of the casing assembly and the surface of the wellbore.

The plugged side wall apertures are then re-opened by introducing a source of heat into the apertured casing section. The heat source is representatively a heated liquid flowed into the casing assembly, but could be another type of heat source, such as steam or an ignited propellant material, if desired. Introduction of such heat source into the casing section melts the plug structures and re-establishes communication between inner and outer side portions of the casing sections through its now re-opened side wall apertures. (In cases where the casing assembly is not cemented-in along the wellbore surface, this communicates the subterranean formation with the interior of the casing assembly via the opened side wall apertures).

Next, fracture areas are created which extend outwardly from the re-opened side wall apertures, through adjacent portions of the sealing layer, and outwardly into the formation. Preferably, this step is performed using a propellant-based stimulation tool, such as a stimulating gun or stimulating stick, lowered into the casing assembly and actuated after the casing side wall apertures are re-opened. Alternatively, an explosive-based stimulation tool could be utilized.

While the plug structures are representatively of a eutectic material, they could be of a variety of other materials, and other techniques could be alternatively utilized to remove them, downhole, from the casing side wall apertures which they sealingly block. For example, the plug structures could be of a frangible material which could be broken downhole, could be of a corrodible material which could be eaten away downhole by an acidic or highly basic liquid introduced into the casing section, or could be of a combustible material which could be ignited and combusted downhole.

In another illustrated embodiment of the completion method described above, a propellant-based stimulation tool lowered into the casing is used to simultaneously remove the casing side wall aperture plug structures and form the fracture areas that extend from the re-opened casing side wall apertures sequentially through the sealing layer and outwardly into the adjacent subterranean formation. The lowered propellant-based stimulation tool may be used to break the plug structures, or the plug structures may be formed from an ignitable propellant material which is ignited and combusted by the hot gases generated by activation of the stimulation tool. Alternatively, an explosive-based stimulation tool could be utilized.

DETAILED DESCRIPTION

Figure 1:
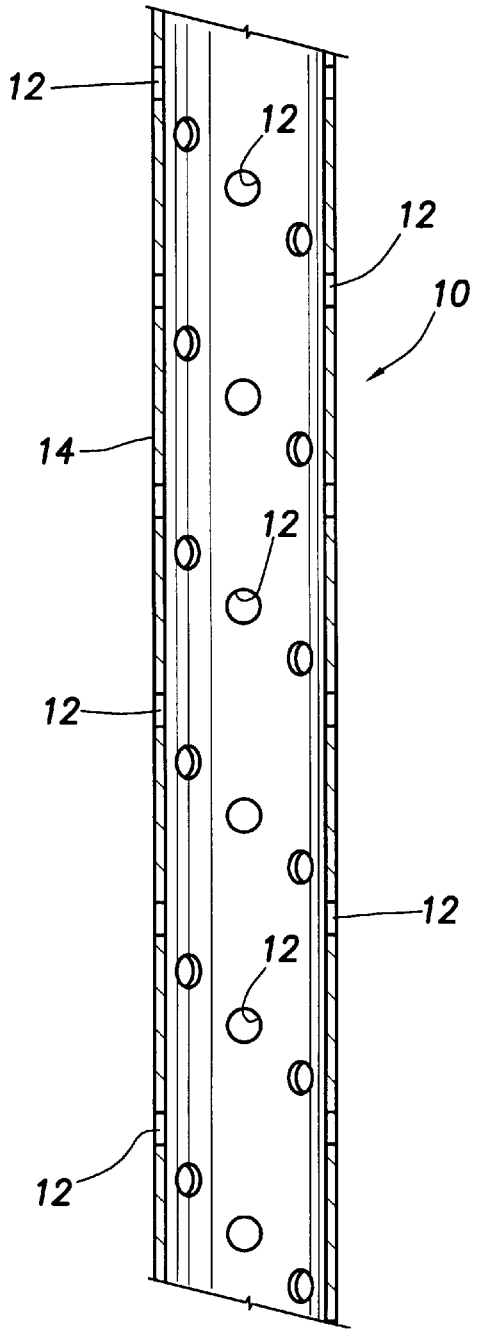
FIG. 1 is a cross-sectional view through a pre-drilled casing section used in completing a subterranean well in accordance with principles of the present invention.

Referring initially to FIG. 1, the present invention provides a tubular metal casing section 10 which is incorporated as a longitudinal portion of a tubular casing assembly operatively installed in a wellbore extending through a subterranean production formation as later described herein. By drilling or otherwise, a spaced series or representatively circular apertures 12 are formed in the side wall 14 of the casing section 10, with each aperture 12 extending completely between the interior and exterior side surfaces of the casing side wall 14.

Figure 2:
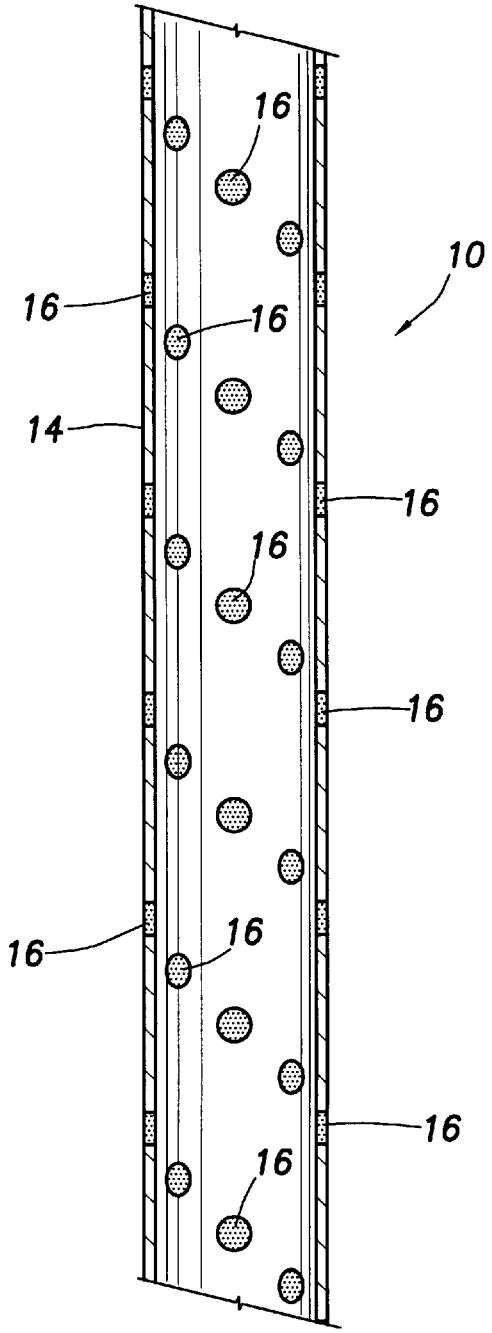
FIG. 2 is a view of the pre-drilled casing section after its side wall apertures have been sealed with plug structures which are representatively formed from a eutectic material.

After the casing side wall apertures 12 are formed, as shown in FIG. 2 they are sealed with schematically depicted plug structures 16. Plug structures 16 are representatively formed from a eutectic material and may be operatively installed on the casing section in a variety of manners. For example, the plug structures 16 may be threaded into the apertures 12, press-fitted into the apertures 12, or molded into the apertures. The melting point of the eutectic material used to form the plugs 16 is selected so that the anticipated subterranean temperature to which the plugs will be subjected when the plugged casing section 10 is positioned within the selected underground formation will not melt the plugs. The specially designed plugged casing section 10, as will now be described, is utilized in a unique well completion method that embodies principles of the present invention.

Figure 3:
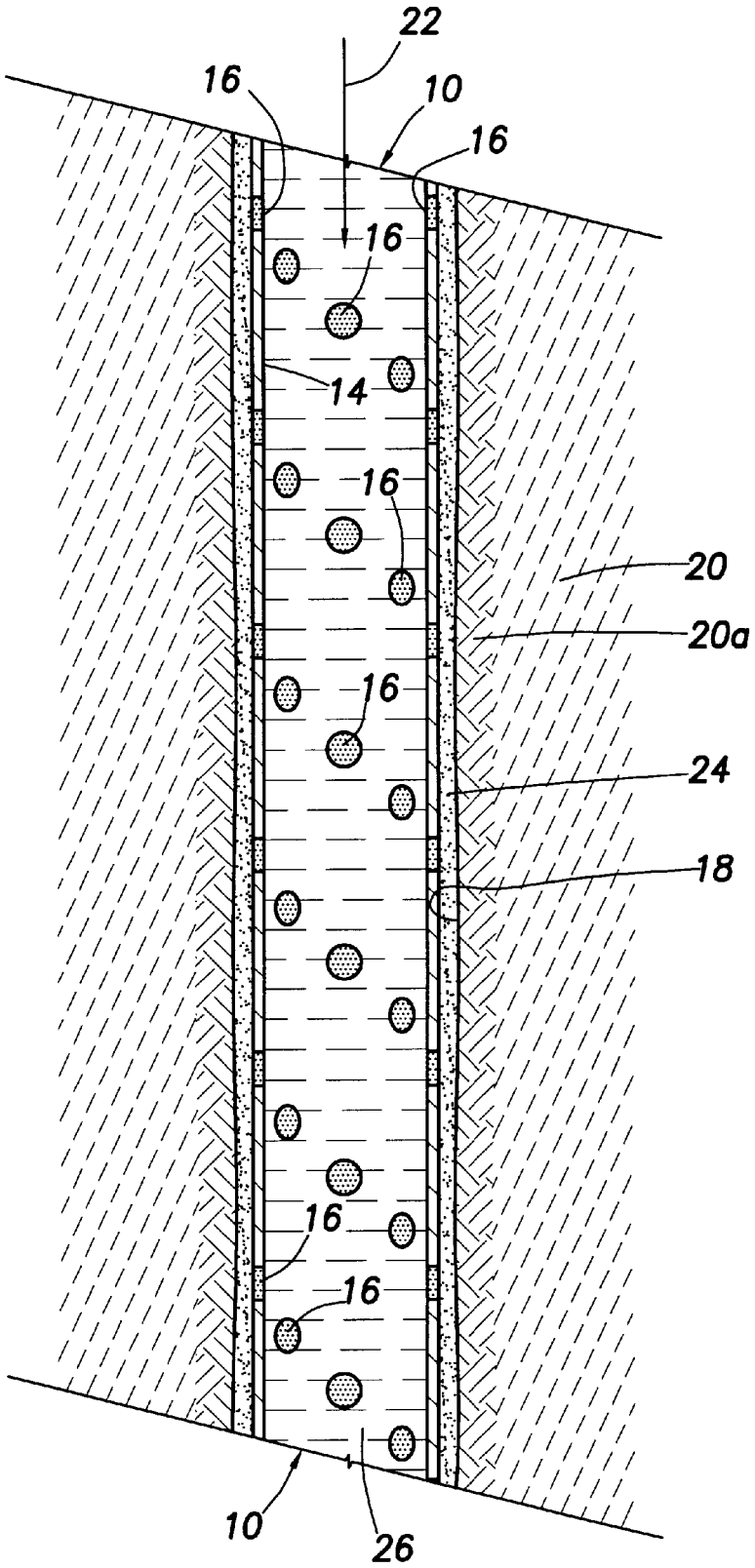
FIG. 3 is a cross-sectional view through the plugged casing section operatively positioned within a well bore at a selected subterranean formation, and further illustrates in schematic form the cementing-in of the casing section and the introduction into its interior of a heated liquid used to melt the eutectic plug material.

FIG. 3 illustrates the plugged casing section 10, as a longitudinal part of an overall tubular metal casing assembly, having been operatively positioned within a subterranean wellbore 18 at a location therein extending through a selected production formation 20. With the casing in place in the wellbore 18 as shown in FIG. 3, a conventional cementing-in operation is performed in which cement is forced downwardly through the casing (as indicated by the arrow 22), outwardly through its bottom end (not shown), and then upwardly through the space between the outer side surface of the casing and the side surface of the wellbore 18 to form the usual hardened cement liner 24 extending around the installed casing and radially extending between the casing and an adjacent portion 20*a* of the formation 20 which tends to be somewhat damaged as a result of the original wellbore drilling operation.

Figure 4:
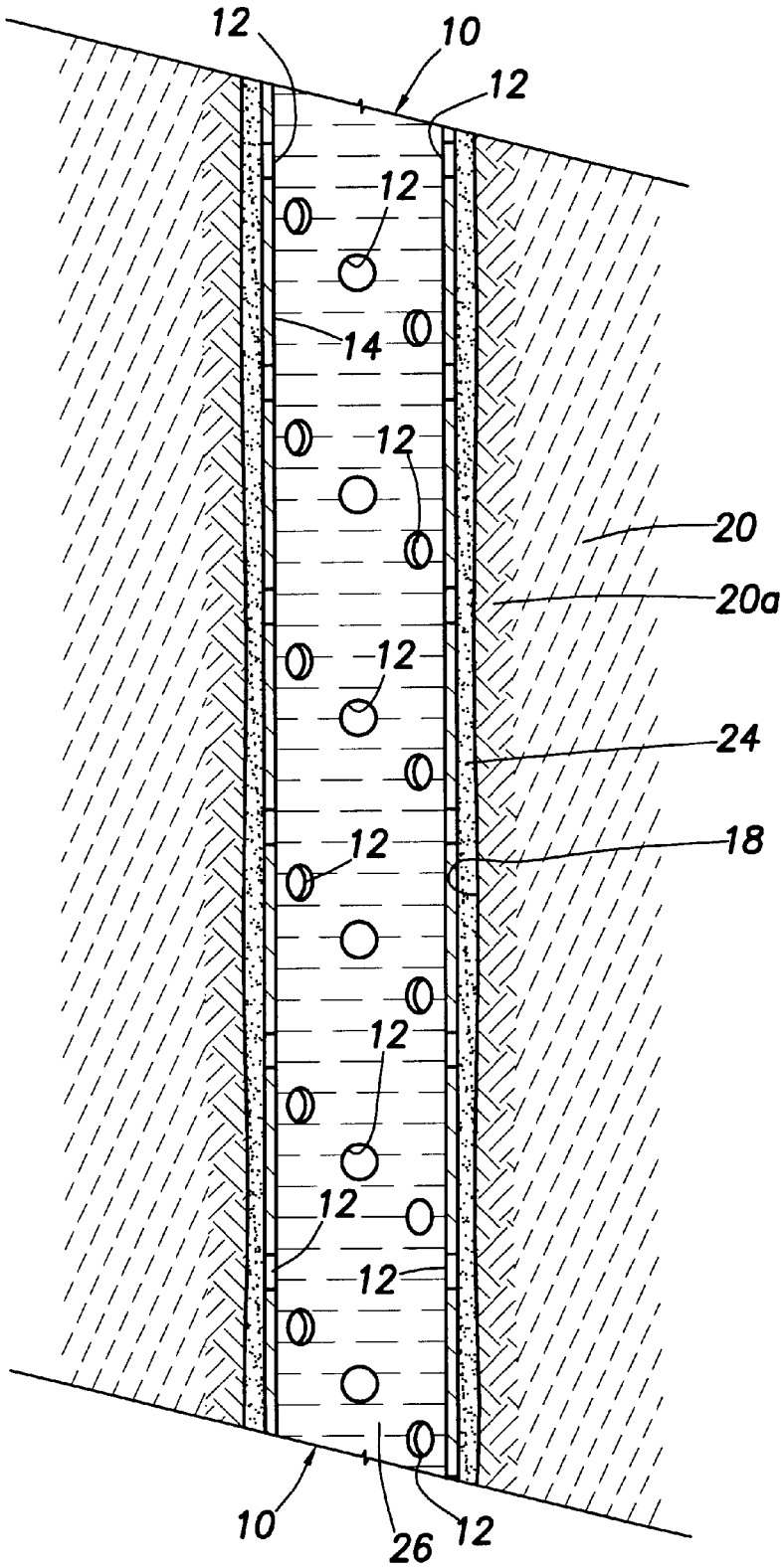
FIG. 4 is a cross-sectional view similar to that in FIG. 3, but with the eutectic casing plugs having been melted by the heated liquid.

After the cement casing liner or sealing layer 24 has been formed, and has hardened, a heat source is applied to the eutectic plug structures 16 to melt them. Representatively, this heat source is in the form of a heated liquid, such as hot water 26 which is recirculated through the casing interior (for example, through a nonillustrated tubing string) to melt the eutectic plug structures 16, as shown in FIG. 4, thereby re-opening the casing section side wall apertures 12. It should be noted that, at this point, if the casing had not been cemented-in the formation 20 would have now been operatively communicated with the interior of the casing without the use of explosive perforating apparatus to create side wall holes in the casing. As will be appreciated, various other types of heat sources could be used to melt the eutectic plug structures 16 and thus provide communication between the outer side surface of the casing and its interior. For example, other hot liquids, steam, or various sources of dry heat could be utilized to melt the plug structures 16 and thus re-open the casing section side wall apertures 12.

Figure 5:
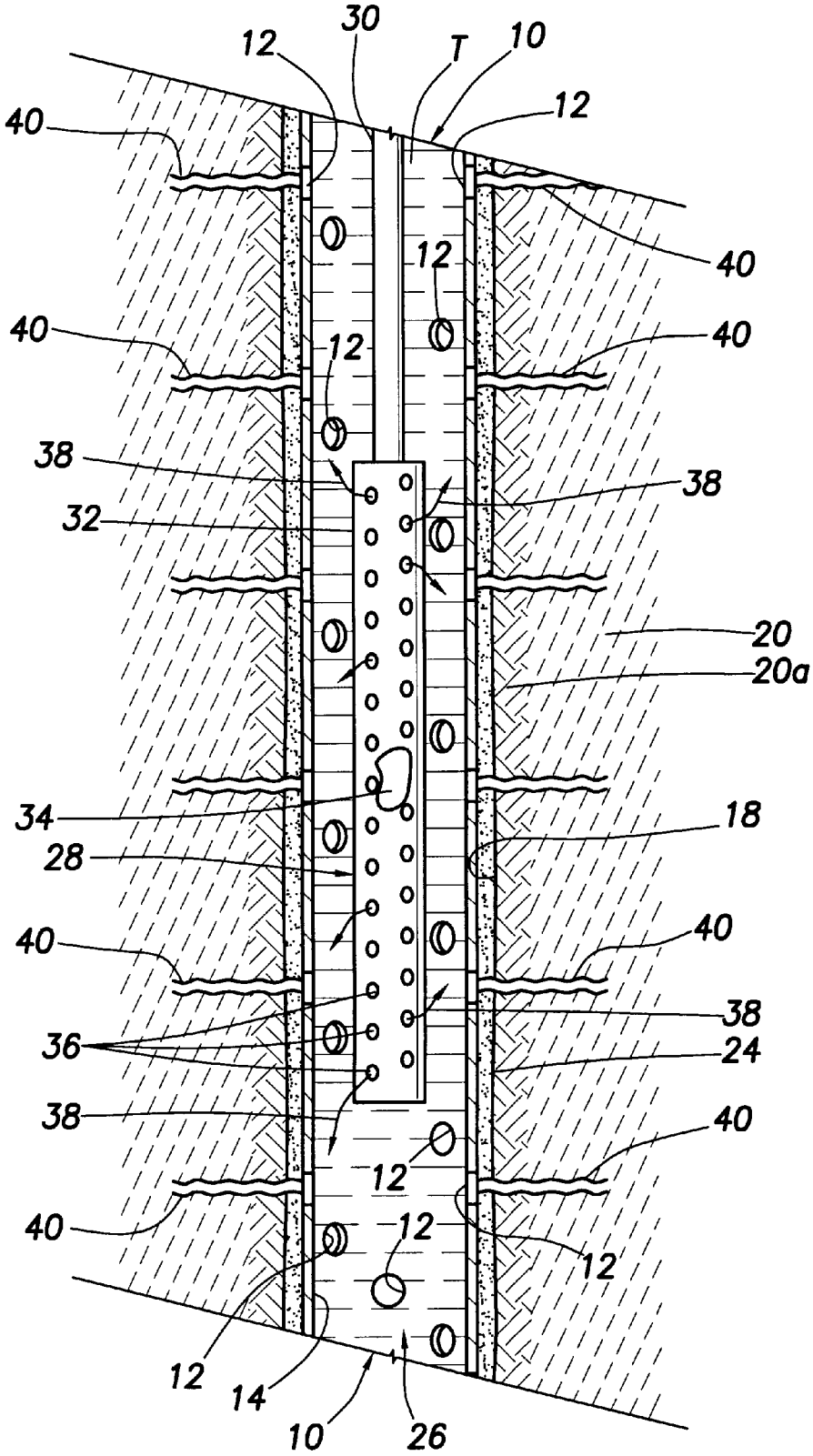
FIG. 5 is a cross-sectional view through the now unplugged casing section illustrating the use of a propellant-base stimulation tool to create communication between the formation and the interior of the casing section.

Turning now to FIG. 5, after the casing section side wall apertures 12 have been re-opened, the liquid 26 is left in the casing for use as a liquid tamp T therein. Next, a propellant-based stimulation tool, illustratively in the form of a schematically depicted stimulating gun 28, is lowered into the now unplugged casing section 10, representatively on a length of metal tubing 30. Stimulating gun 28 may alternatively be lowered on a wireline if desired. The stimulating gun 28 is of a conventional construction, and includes a tubular metal body 32 filled with an ignitable propellant material 34 and having side wall perforations 36. The propellant material is representatively potassium perchlorate mixed in a suitable epoxy binder material.

After the stimulating gun 28 is in place within the casing section 10 and the liquid tamp T, the propellant material 34 is ignited to thereby create high temperature, pressure and velocity propellant streams 38 which are discharged outwardly from the metal gun body 32 into the interior of the casing section 10. The ignited propellant material thus discharged from the gun body 32 is forced outwardly through the now reopened casing section side wall apertures creates fracture areas 40 extending outwardly from the side wall apertures 12 sequentially through the cement liner 24 and into the adjacent formation 20, thereby operatively communicating the formation 20 with the interior of the casing section 10, and thus the balance of the casing assembly, without the use of explosive devices, such as a shaped charged perforating gun, within the casing.

Figure 6:
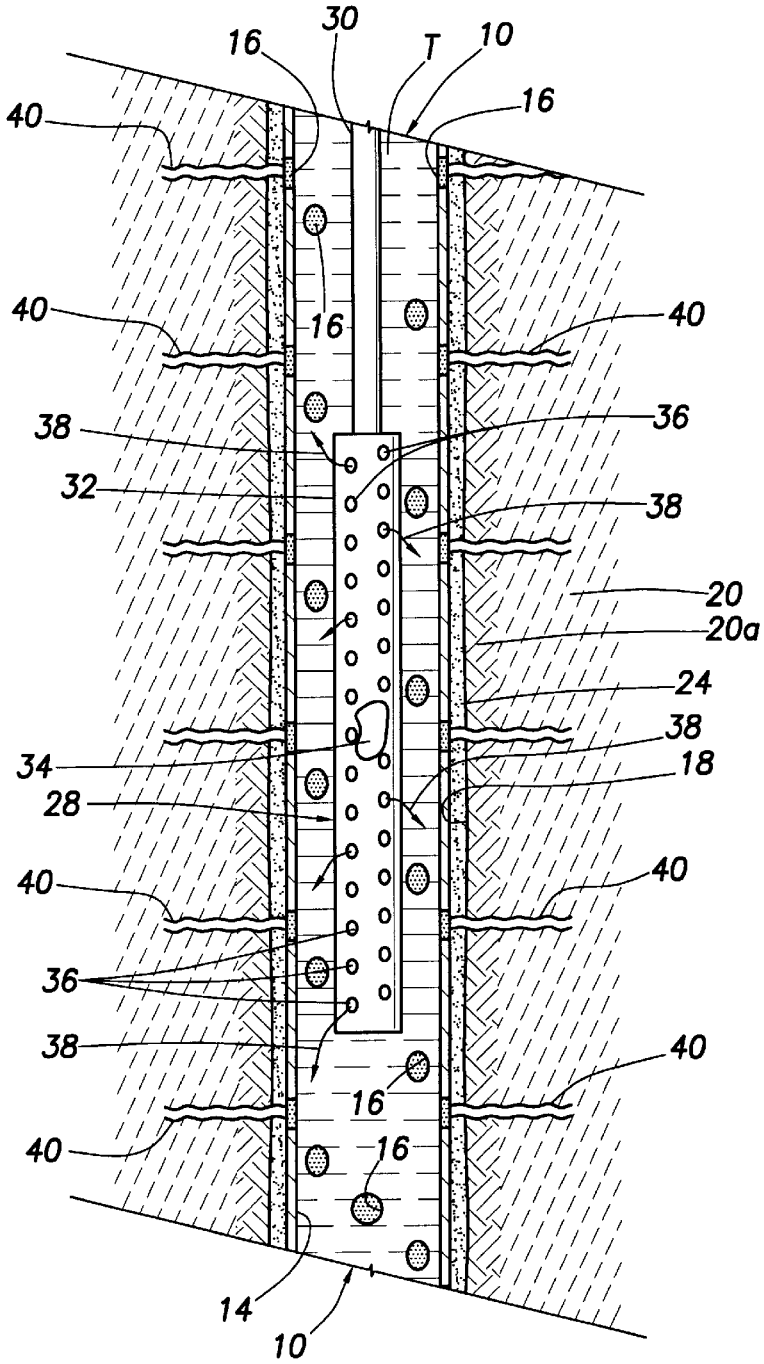
FIG. 6 is a cross-sectional view through an alternate embodiment of the pre-drilled, plugged casing section operatively installed in the well bore and illustrates the use of a propellant-based stimulation tool to both unplug the casing side wall apertures and pierce portions of the surrounding formation to create communication between the formation and the interior of the casing section.
Figure 6A:
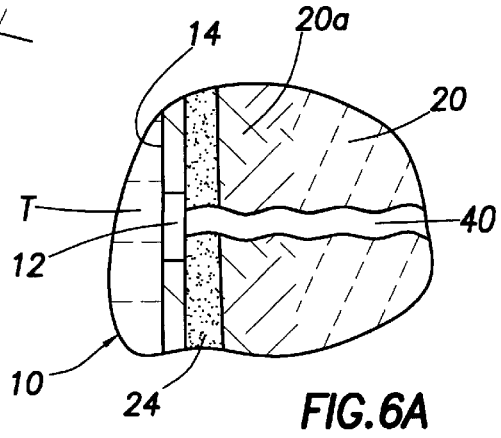
FIG. 6A is an enlarged scale cross-sectional view through a portion of the casing section illustrating the formation communication with the interior of the casing section via an unplugged casing side wall aperture and an adjacent stimulation intrusion into the formation.

A variation of this propellant-based completion method is illustrated in FIG. 6 in which a propellant-based stimulation tool, such as the representatively depicted stimulation gun 28, is used to simultaneously remove the plug structures 16 and create the fracture areas 40. In this method, the stimulating gun 28 is placed in the casing section 10, within a suitable liquid tamp T extending therethrough, and fired by igniting the propellant 34 to create the previously described propellant streams 38. The ignited propellant 34 is used in this method to simultaneously remove the plug structures 16, thereby re-opening the casing side wall apertures 12 as shown in FIG. 6A, and form the fracture areas extending from the apertures 12 outwardly through the cement liner 24 and into the adjacent formation 20.

The discharged propellant 38 may be used to break the plug structures 16 (which are correspondingly formed from a suitable frangible material), or the plug structures 16 may be formed from an ignitable propellant material (such as the propellant material used in the gun 28) and ignited and combusted by the heat generated by the hot discharged propellant streams 38.

As can readily be seen from the foregoing, the present invention provides apparatus and methods for completing a subterranean well without the previous necessity of utilizing explosive material-based stimulation tools such as a shaped charge perforating gun. In addition to the various representatively illustrated techniques for removing the plug structures 16, and thus re-opening the casing side wall apertures 12 downhole, other techniques could alternatively be utilized if desired. For example, when eutectic material plugs are utilized various other types of heat sources could be used to melt the plug structures—for example, hot oil or steam introduced into the pre-drilled casing section 10.

Additionally, hollow plugs with closed ends projecting into the casing section interior could be used, with the plugs being openable by passing a suitable milling tool downwardly through the casing section 10 to cut off the inner ends of the plugs and thereby communicate the exterior of the casing section with its interior via the interiors of the now opened plug structures. Further, the plug structures could formed of a suitable material which would be corroded away by introducing an acidic or highly basic liquid into the casing.

While a propellant stimulating gun 28 has been illustrated as being used to create the fracture areas 40, it will be readily appreciated by those of skill in this particular art that other types of propellant-based tools could alternatively be utilized if desired. As but one example, a stimulating stick device, in which a propellant material encapsulates a support member lowered into the casing on a wire line, could also be used if desired.

The foregoing detailed description is to be clearly understood as being given by way of illustration and example only, the spirit and scope of the present invention being limited solely by the appended claims.

What is claimed is:

1. A method of completing a well having a wellbore extending through a subterranean formation, the method comprising the steps of:

providing a casing section having side wall apertures sealingly covered by plug structures;

positioning the casing section in the wellbore at the formation; and uncovering the casing section side wall apertures within the wellbore.

2. The method of claim 1 wherein:

the plug structures are formed from a eutectic material, and the uncovering step is performed utilizing the step of heating and melting the plug structures within the wellbore.

3. The method of claim 2 wherein the heating and melting step is performed by introducing a source of heat into the casing section.

4. The method of claim 3 wherein the source of heat is introduced into the casing section by flowing a heated fluid into the casing section.

5. The method of claim 1 wherein the uncovering step is performed by breaking the plug structures.

6. The method of claim 5 wherein the step of breaking the plug structures is performed by operating a stimulation tool within the casing section.

7. The method of claim 1 wherein:

the plug structures are formed from a propellant material, and the uncovering step is performed by operating a stimulation tool within the casing section in a manner igniting the plug structures.

8. The method of claim 1 wherein the uncovering step is performed by flowing a liquid into the casing section.

9. A method of completing a well having a wellbore extending through a subterranean formation, the method comprising the steps of:

providing a tubular casing section having spaced side wall apertures therein;

sealing the side wall apertures with plug structures;

positioning a casing assembly, having a longitudinal portion defined by the apertured casing section, within the wellbore with the plugged casing side wall apertures adjacent a portion of the formation;

forming a sealing layer outwardly around the positioned casing assembly by sequentially flowing a sealing material downwardly therethrough, outwardly therefrom, and then upwardly between the exterior of the casing assembly and the surface of the wellbore;

re-opening the plugged side wall apertures; and creating fracture areas that extend outwardly from the re-opened side wall apertures, through adjacent portions of the sealing layer, and outwardly into the formation.

10. The method of claim 9 wherein the step of re-opening the plugged side wall apertures is performed by melting the plug structures.

11. The method of claim 9 wherein the step of re-opening the plugged side wall apertures is performed using a stimulation tool positioned in the casing section.

12. The method of claim 9 wherein the steps of re-opening the plugged side wall apertures and creating fracture areas are performed using a stimulation tool positioned in the casing section.

13. The method of claim 9 wherein the step of re-opening the plugged side wall apertures is performed by breaking the plug structures.

14. The method of claim 9 wherein:

the plug structures are formed from a propellant material, and the step of re-opening the plugged side wall apertures is performed by igniting the plug structures.

15. The method of claim 9 wherein the step of re-opening the plugged side wall apertures is performed by flowing a liquid into the casing section.

16. A method of completing a well having a wellbore extending through a subterranean formation, the method comprising the steps of:

providing a tubular casing section having spaced side wall apertures therein;

sealing the side wall apertures with eutectic plug structures;

positioning a casing assembly, having a longitudinal portion defined by the apertured casing section, within the wellbore with the plugged casing side wall apertures adjacent a portion of the formation;

forming a sealing layer outwardly around the positioned casing assembly by sequentially flowing a sealing material downwardly therethrough, outwardly therefrom, and then upwardly between the exterior of the casing assembly and the surface of the wellbore;

melting the eutectic plug structures by creating a column of a heated liquid within the casing assembly;

lowering a propellant-based stimulation tool through the column of liquid to a position adjacent the apertured casing section; and operating the stimulation tool to create fracture areas that extend outwardly from the re-opened side wall apertures, through adjacent portions of the sealing layer, and outwardly into the formation.

17. A method of completing a well having a wellbore extending through a subterranean formation, the method comprising the steps of:

providing a tubular casing section having spaced side wall apertures therein;

sealing the side wall apertures with plug structures;

positioning a casing assembly, having a longitudinal portion defined by the apertured casing section, within the wellbore with the plugged casing side wall apertures adjacent a portion of the formation;

forming a sealing layer outwardly around the positioned casing assembly by sequentially flowing a sealing material downwardly therethrough, outwardly therefrom, and then upwardly between the exterior of the casing assembly and the surface of the wellbore;

lowering a propellant-based stimulation tool through the casing assembly to a position adjacent the apertured casing section;

disposing a liquid tamp within the casing assembly, the liquid tamp extending upwardly past the lowered stimulation tool; and communicating the formation with the interior of the apertured casing section, by creating fracture areas extending sequentially outwardly through the casing section side wall apertures, the sealing layer and the formation, using the lowered propellant-based stimulation tool.

18. The method of claim 17 wherein the lowered propellant-based stimulation tool is used to break the plug structures in conjunction with creating the fracture areas.

19. The method of claim 17 wherein:

the plug structures are formed from a propellant material, and the lowered propellant-based stimulation tool is used to ignite the plug structures in conjunction with creating the fracture areas.

20. Apparatus for use in completing a well having a wellbore extending through a subterranean formation, the apparatus comprising:

a tubular casing section supportingly positionable within the wellbore at the formation, the tubular casing section having a spaced series of side wall apertures therein; and a series of plug structures carried by the tubular casing section and sealingly blocking the side wall apertures therein, the plug structures being removable downhole to re-establish communication between the exterior and interior of the casing section via the side wall apertures.

21. The apparatus of claim 20 wherein the plug structures are formed from a eutectic material.

22. The apparatus of claim 20 wherein the plug structures are formed from a frangible material.

23. The apparatus of claim 20 wherein the plug structures are formed from an ignitable propellant material.

* * * * *